US005979804A

United States Patent [19]

Abrams et al.

[11] Patent Number: 5,979,804

[45] Date of Patent: Nov. 9, 1999

[54] PARTICULATING APPARATUS AND METHOD

[75] Inventors: Robert S. Abrams, Albany; Robert Thomas Garren, Jr., Fultonville, both of N.Y.

[73] Assignee: Capitol Vial, Inc., Fultonville, N.Y.

[21] Appl. No.: 08/608,900

[22] Filed: Feb. 21, 1996

[51] Int. Cl.[6] ..... B02C 19/14; B02C 23/18

[52] U.S. Cl. ..... 241/15; 241/24.11; 241/27; 241/41; 241/79.1; 241/186.35; 241/186.5; 241/606

[58] Field of Search ..... 241/15, 24.11, 241/24.28, 27, 38, 79.1, DIG. 38, 186.35, 41, 186.5, 606

[56] References Cited

U.S. PATENT DOCUMENTS

| | | | |
|---|---|---|---|
| 3,322,355 | 5/1967 | Bryant . | |
| 3,687,062 | 8/1972 | Frank . | |
| 3,750,966 | 8/1973 | Anderson . | |
| 3,926,379 | 12/1975 | Dryden et al. . | |
| 3,929,295 | 12/1975 | Montalbano . | |
| 4,153,206 | 5/1979 | Haefner et al. . | |
| 4,205,794 | 6/1980 | Horton et al. . | |
| 4,531,437 | 7/1985 | Szablak et al. . | |
| 4,619,409 | 10/1986 | Harper et al. . | |
| 4,655,404 | 4/1987 | Deklerow | 241/99 |
| 4,759,508 | 7/1988 | Griffith et al. . | |
| 4,809,915 | 3/1989 | Koffsky et al. . | |
| 4,884,756 | 12/1989 | Pearson et al. . | |
| 4,971,261 | 11/1990 | Solomons . | |
| 5,096,130 | 3/1992 | Gulmini . | |
| 5,178,336 | 1/1993 | Lodovico et al. . | |
| 5,186,331 | 2/1993 | Valster . | |
| 5,292,075 | 3/1994 | Bartlett | 241/20 |
| 5,346,142 | 9/1994 | Miller et al. . | |
| 5,366,165 | 11/1994 | Jackman | 241/24 |
| 5,389,347 | 2/1995 | Hall et al. . | |
| 5,437,414 | 8/1995 | Hall . | |
| 5,566,890 | 10/1996 | Ricciardelli | 241/20 |
| 5,720,438 | 2/1998 | Devine et al. | 241/21 |

*Primary Examiner*—John M. Husar
*Attorney, Agent, or Firm*—Dreier & Baritz, LLP.

[57] ABSTRACT

A particulating apparatus for liquid filled plastic containers in preparation for recycling produced plastic particulate. The particulating apparatus includes a container hopper for accepting a supply of plastic containers to be processed by the particulating apparatus wherein at least a portion of the containers are partially liquid filled. There is a transport for conveying the supply of plastic containers from the hopper to a pulverizer. The pulverizer has a pulverizing chamber within which a pulverizing means is housed for reducing the plastic containers to plastic particulate. The chamber includes means for draining liquid held within the containers to a liquid collector. A conveyor means is provided for transporting plastic particulate from the pulverizer to a collection bin where the particulate is retained for further processing or disposal. The conveyor means is inclined at least partially vertically upwardly from horizontal to permit drainage of additional liquid from the particulate. A method of particulating liquid filled containers into particulate is also disclosed that includes supplying containers, at least a portion of which contain liquid, to a pulverizing chamber. The containers are subjected to mechanical stress to break up the container walls to produce a particulate and to release the contained liquid. At least a portion of the released liquid is drained therefrom. The partially drained particulate is moved to a collection bin. The movement is directed upwardly to permit additional drainage of remaining liquid. A disinfectant is suppled to the containers prior to movement to the collection bin.

22 Claims, 4 Drawing Sheets

PARTICULATING APPARATUS AND METHOD

This invention relates to particulators of containers. More particularly, it relates to particulating apparatus for breaking up liquid carrying plastic containers and separating the liquid from produced plastic particulate.

BACKGROUND OF THE INVENTION

Many industries dealing with the production and processing of liquids require capabilities for sampling those liquids for various purposes. Commonly, samples of the liquids will be taken for examination and analysis pursuant to a quality assurance program. Most liquid manufacturers and processors require such sampling to assure uniformity of the end product. Many consumer products serve as examples of liquids that are sampled for testing purposes. This is particularly true with liquid items that are to be consumed by the public. Not only are the manufacturers and processors concerned with the quality of the product from a commercial standpoint, but in many instances they must also comply with certain regulations pertaining to the quality of the product. An example of such users of sampling techniques are processors of liquid dairy products. In the instance of milk, there are multiple opportunities during the several processing stages between the animal source and the grocers' shelves during which the milk may become contaminated or spoiled and unfit for human consumption. In many cases, the first instance of test sampling will be shortly after the cow has been milked. In this way the specimen can be identified with the particular animal in the event that anomalies are detected when the sample is analyzed.

Other industries obtain and process particular liquid samples from many different sources. One such industry includes testing laboratories that analyze bodily fluids for detecting conditions present in a person's or animal's body. An example associated with the medical field is the collection of urine for the purpose of detecting certain qualities of the urine that are indicative of physical conditions of the donor. In one instance, the urine may be tested to determine whether or not a patient is diabetic. Similarly, blood samples may be drawn from a patient to ascertain other conditions.

In a similar industry, bodily fluid samples are taken for determining the presence of foreign substances such as alcohol and drugs. This is becoming an important industry both from a law enforcement perspective, as well as that of employers who have testing policies. Because of the extreme consequences associated with the results of these tests, it is of paramount importance that they be accurate and remain uninfluenced by outside factors.

In each instance described above in which a liquid sample is taken for analysis purposes, it is important that the specimen does not become contaminated either after it is initially taken and before it is first accessed for testing purposes. It is also important that the specimen not be contaminated after being accessed for initial testing since further testing of the specimen may be required based upon the results of the prior test(s). This requirement may necessitate special handling of the samples, but at a minimum requires that the container within which the specimen is carried be sufficiently closed after the specimen is test sampled to prevent the introduction of contamination.

It is likewise important that the container be free of contamination prior to the sample being dispensed into the container. To assure the purity of the sample carried in the container, it is a common practice for the container to be closed before the sample is introduced and then reclosed immediately after the sample has been dispensed therein. After the specimen has been placed within the container and the container has been closed, the specimen may be transported to the location at which it is to be analyzed.

Often times, only a small portion of the specimen will be required for analysis and the balance of the sample must be disposed of properly. The container itself can be recycled. In many instances, the sample to be analyzed may be withdrawn in a fashion that permits the container to remain substantially closed so that it retains the balance of the liquid specimen carried therein.

In the event that the sample containers or bottles retain portions of a liquid sample that must be appropriately discarded, special treatments may be required because of the nature of both the container and the conditions of the liquids themselves. Oftentimes, the specimens may be toxic or otherwise contaminated, or potentially contaminated so that neutralization is required before ultimate disposal.

The containers themselves may be manufactured from a variety of materials, but in most cases will be produced from plastic if that material is suitable for the containment of the liquid specimens to be analyzed. Because of the containers' plastic construction, it is possible that the bodies of the containers may be further processed to either reduce their volume for disposal purposes or otherwise processed for subsequent use; one such use would be as source material for the manufacture of other plastic items through recycle.

In some situations, not all of the containers will contain liquid, but there is the potential that at least some will still contain liquid after their primary use as specimen containers. Still further, it is possible that some of the containers may be sufficiently open so that liquid freely escapes therefrom and is commingled with and about the other containers when stored together before being further processed. In these cases, the present invention strives to provide means by which the escaping liquid may be drained from about the containers prior to further processing. If desired, a rinse may also be applied to the containers that is drained together with the escaping portions of the specimens.

The present invention provides an apparatus having the ability to drain remaining liquid specimen held within the containers and separate the liquid from the solid components of the containers. In this manner, each may be appropriately treated for subsequent but separate processing. In the process of separating the contained liquid specimen from the sample bottle, the body of the bottle is normally pulverized into smaller pieces of plastic particulate. During the separation and particlization processes, the draining liquid must be collected and drained from the unit. Therefore, the present invention provides a liquid collector associated with the pulverizing unit.

In some circumstances, the particulate remains "dirty" with traces of the specimen adhering to the individual pieces after fragmentation and may require additional cleansing, even if only by a water rinse. Therefore, the present invention provides one or more rinses in association with the draining process.

In many situations, the liquid specimen will itself include offensive or infectious components that have contaminated the container so that the sample bottle must be disinfected before certain other processes may be applied thereto. For these reasons, the present invention not only separates the liquid specimen from the container or sample bottle, but also provides a means for disinfecting the containers after the liquid has been removed therefrom.

In many instances, the specimen held within the container may have other noxious qualities that can result in the release of offensive gases upon the opening and processing of the closed container. Therefore, this invention provides a capability for evacuating and exhausting any such released or produced noxious gas. From the exhaust vacuum, the gases may be ported to the environment if their condition is suitable for direct release, or they may be additionally treated if so required prior to release.

In order to more completely cleanse the particulate, additional rinsing means may be optionally incorporated into the system of the present invention downstream from the pulverizing process and configured so that the rinsing fluid may be drained from the particulate before it is deposited into a collection bin where it is held for further processing or disposal.

Heretofore, no system has been available for adequately processing used sample bottles of the nature described above in a manner similar to the present invention. Several apparatus and methods are known for reducing the size of certain containers and other instruments that are most often associated with the medical field. Those known means and apparatus, however, do not contemplate the processing and separation of containers from the liquid specimens they hold, particularly when the volume of liquid specimen is appreciable.

An example of an apparatus for crushing small containers is found in U.S. Pat. No. 4,759,508 issued to Griffith et al. Therein, a pair of cooperating crusher rolls rupture vials containing a scintillation liquid and permit the same to be expelled therefrom. The Griffith apparatus, however, does not particulate the bodies of the containers for purposes of further processing. Another example of a waste treatment system is found in U.S. Pat. No. 4,884,756 issued to Pearson. Therein, infectious waste is shredded and then disinfected in a bath. The disinfected solid waste is then separated out of the bath. The inclusion of appreciable volumes of liquid specimen with the solid waste is not, however, contemplated.

In view of the advantageous features described hereinabove as desirable in a particulating apparatus, and heretofore unavailable, the new particulator described herein has been invented.

SUMMARY OF THE INVENTION

This invention includes features and/or components that have been invented and selected for their individual and combined benefits as a particulating apparatus. The particulating apparatus includes several components having new and novel features that are enhanced by their incorporation into a system. In one embodiment, the present invention includes a method of particulating liquid filled containers into particulate that includes supplying containers, at least a portion of which contain liquid, to a pulverizing chamber. The containers are subjected to mechanical stress to break up the container walls to produce a particulate and to release the contained liquid. At least a portion of the released liquid is drained away from the particulate. The solid particles may then be optionally rinsed and sterilized or disinfected with a solution. Finally, the particulate is conveyed to a collection bin where it is held for further processing. During this conveyance process, liquid that includes both additional portions of the liquid sample, as well as rinse and sterilization solution, is permitted to drain from the solid particulate and be collected with the other drained liquids.

The particulating apparatus of the present invention, which is also referred to as a particulator, has been designed to realize the desired advantages and benefits described hereinabove. This particulating apparatus may be used to reduce containers, sample bottles and sample vials of various designs, sizes and materials of construction to particulate matter. A primary advantage of the particulator is that it accommodates both empty containers, as well as those holding liquids. The containers may be open or closed and the supply of containers to be processed may comprise any proportional mix between empty bottles, full bottles, and others that are partially filled. It is contemplated that the present invention may be utilized to process containers constructed from various materials, but a preferred embodiment that is described herein focuses on the processing of plastic containers or bottles that are also described as sample vials. The sample vials may have various designs and be constructed so that they can be initially sterilized and closed so that the interior remains clean until being accessed to deposit a liquid specimen therein. Following the deposit, the design of at least some of the vials permits reclosure and the establishment of a closed sample container. In at least one sample vial embodiment, a "tamper-proof" indicator is included for assuring that the vial has not been opened since the deposit was made and prior to analysis. For purposes of the disclosure made herein, the vial will be described as it is used in the sampling of milk products in the dairy industry.

The testing process begins by taking milk samples from the product flow and depositing them into sample bottles or vials. The vials are closed and then transported to the location at which analysis of the sample is to take place. In most cases, this location will be a laboratory facility. At the laboratory, a small portion of the liquid specimen is withdrawn from the sample vial for examination. Because a substantial portion of the total specimen deposit is not consumed in many testing processes, an appreciable volume of liquid may remain in the vial and must be disposed of together with the container. In many cases it has been found to be impractical to attempt to clean the sample vials for reuse. Instead, the containers are broken down into reduced sized fragments thereby establishing a plastic particulate that may be discarded or further processed. In the case of the present invention, the contained liquid specimen is released from within the sample vial during the particulating process. In the event of direct disposal of the fragmented pieces, the produced particulate occupies substantially less space than the fully assembled sample vials. In this manner, the landfill area required to dispose of the containers is drastically reduced. An example of additional processing of the particulate includes its recycle into other items.

Prior to the particlization process, but after the specimen has been accessed for examination purposes, the vials are stored in a hopper from which the containers are supplied to the pulverizer. At this stage, the vials may or may not be completely closed and it is possible that portions of the liquid specimens held therein will escape while in the hopper. Therefore, a drain may be optionally provided at the hopper for withdrawing these released liquids away from the particulator. If desired, a pre-rinse may also be sprayed upon the containers while in the hopper, or while being conveyed from the hopper to the pulverizing chamber for flushing any released specimen away from the sample bottles.

Because a portion of the sample vials are at least partially liquid filled, it is an important feature of the particulating apparatus that separation between the liquid and the plastic particulate be achieved. A first stage of separation is accomplished in a pulverizing chamber in which the walls of the vial are initially broken down and the containers opened. Upon opening, and during the particulating process the contained liquid is permitted to escape from within the vial and drain therefrom. As the vials fall through the pulverizing chamber, a great portion of the carried liquid drains downwardly out of the chamber and into one or more liquid collectors that have been located beneath the chamber. At some point along the flow path that the vial takes from a supply hopper and through the pulverizing chamber, a disinfectant may be optionally applied. It is contemplated that the disinfectant may be applied to the vials before they are introduced into the pulverizing chamber, after they are introduced into the chamber but prior to particlization, or during the particlization process. The disinfectant may be applied to serve two purposes. The first is to disinfect the plastic particulate that is produced in the pulverizing process and the second is to treat the liquid that drains off of the particulate.

A rinsing means is provided within the pulverizing chamber for washing additional amounts of liquid specimen from the particulate matter. It is contemplated that the rinse may be utilized with or without the disinfectant. In any event, the rinse, which is typically a solution predominantly comprising water, is drained from the pulverizing chamber together with the released liquid specimen.

Though a great portion of the liquid processed through the pulverizing chamber drains into provided collection or catch pan(s) as the plastic particulate exits the pulverizing chamber, a certain amount of liquid remains with a particulated matter and may advantageously be drained in subsequent conveyances of the invention. In the illustrated and described embodiments, a conveyor is utilized that incorporates an inclined rotatable screw conveyor within a housing that permits additional liquid to drain from the particulate matter as it is being conveyed upwardly away from a particulate exit of the pulverizing chamber. The cylindrical housing of the conveyance acts as a sleeve having a lower portion that guides the additionally drained liquid backwardly and downwardly toward the liquid collector into which the liquid is ported. By design, the cylindrical housing or sleeve acts as a conduit for the additionally draining liquid and appropriately directs it to the point of collection. The inclined orientation of the conveyor freely permits the liquid to naturally drain by gravity back toward the collector in a direction opposite to the direction of travel of the particulate in the conveyor. By the time the particulate has been transported to a collection bin where it is retained for further processing, a sufficient amount of liquid has been drained therefrom and it is then suitable for intended future processing. In an alternative embodiment, a post rinsing means is provided in the inclined conveyor for dispensing a final rinse onto the moving particulate prior to its deposit into the collection bin. The rinse solution drains backward down the inclined conveyor to the liquid collecting catch pan(s).

An exhaust vacuum is optionally provided for the particulator so that any offensive or noxious gas may be removed therefrom. After evacuation, the removed gas may be either released at a point remote from the particulator if in an acceptable condition for release, or the gas may be further processed until suitably conditioned for release.

The particulating apparatus comprises several components whose operation may be advantageously coordinated during use. A controller of conventional design supplies this coordination thereby at least partially automating operation of the particulating apparatus. The controller may also be used to monitor certain conditions within the particulator to assure proper operation and shut the apparatus down in the event of malfunction. Among those phases of operation that may be desirably monitored and/or operationally controlled are the following examples: the draining processes, including the liquid levels within the catch pans; the running condition of the transporting belt between the hopper and the pulverizer; the various rinse applicators, as well as the disinfectant applicator; the fluid supplies for each of the applicators; the condition of the pulverizing chamber to assure that it has not become plugged; the running condition of the screw conveyor; and the fill level of the particulate collection bin. The totality of the structure of the particulating apparatus is made portable by mounting the components on wheeled chassis. By this design, the particulator may be moved about to different locations within a specific facility or transported from one facility to another.

Referring now to specific embodiments of the particulating apparatus, additional benefits and advantageous features will be appreciated. In one embodiment of the present invention, a particulating apparatus is provided for liquid filled plastic containers in preparation for recycling produced plastic particulate. The particulating apparatus includes a container hopper for accepting a supply of plastic containers to be processed by the particulating apparatus wherein at least a portion of the containers are partially liquid filled. There is a transport for conveying the supply of plastic containers from the hopper to a pulverizer. The pulverizer has a pulverizing chamber within which a pulverizing means is housed for reducing the plastic containers to plastic particulate. The chamber includes means for draining liquid held within the containers to a liquid collector. A conveyor means is provided for transporting plastic particulate from the pulverizer to a collection bin where the particulate is retained for further processing or disposal. The conveyor means is inclined at least partially vertically upwardly from horizontal to permit drainage of additional liquid from the particulate.

The particulator also includes a liquid collector configured for collecting draining liquid from the pulverizer and the conveyor means.

The conveyor means includes a housing for directing the additional liquid drained from the particulate while in the housing toward the liquid collector.

The inclined conveyor means for transporting plastic particulate from the pulverizer to the collection bin further includes: the housing being substantially cylindrically shaped and having a rotatable screw housed therein; a plastic particulate entrance port located at a lower end of the conveyor means and positioned proximate to a particulate exit of the pulverizing chamber; and liquid drainage apertures in the housing for permitting liquid to drain therefrom to the liquid collector.

The particulator also includes a disinfectant applicator for dispensing a disinfecting agent onto the plastic particulate before the particulate is conveyed to the collection bin.

In another embodiment of the present invention, the particulator also includes a disinfectant applicator for dispensing a disinfecting agent onto the plastic containers within the pulverizing chamber so that the produced plastic particulate is at least partially disinfected in preparation for additional processes in which plastic particulate is consumed or disposed.

The liquid collector has at least one drain pan positioned at least partially below the pulverizer and the drain pan has a drain conduit that is fluidly connected between the drain pan and a liquid collecting reservoir.

In yet another embodiment, the at least one drain pan comprises a plurality of drain pans where each is fluidly communicated with one another for common drainage through the drain conduit.

The particulator also includes an exhaust vacuum fluidly connected to the particulating apparatus for removing gas therefrom.

In at least one embodiment, the transport for conveying the supply of plastic containers from the hopper to the pulverizer is an inclined continuous belt conveyor.

In another embodiment of the invention, a method for particulating liquid filled plastic containers into plastic particulate is disclosed. The method includes the steps of supplying a plurality of plastic containers to a pulverizing chamber of a particulating apparatus. Of those plastic containers, at least a portion are partially liquid filled. The plastic containers are pulverized to produce plastic particulate and release the liquid. A portion of the released liquid is drained from the pulverizing chamber and collected in a liquid collector for further processing or disposal. The plastic particulate is also collected in a collection bin for further processing or disposal.

The method additionally includes transporting the plastic particulate from the pulverizing chamber to the collection bin in a conveyor means. The conveyor means is inclined at least partially vertically upwardly from horizontal toward the collection bin. Additional liquid is drained from the particulate during transport upwardly in the conveyor means.

The method additionally includes porting the conveyor means with liquid drainage apertures so that the additional liquid drained from the particulate is permitted to exit the conveyor means into the liquid collector.

The method additionally includes collecting the additionally drained liquid from within the conveyor means together with the initially drained liquid from within the pulverizing chamber in the liquid collector.

The collection of liquid further includes positioning at least one drain pan beneath the pulverizing chamber and the drainage apertures of the conveyor means.

The method additionally includes draining collected liquid from the drain pan to a liquid collecting reservoir for retention until the collected liquid is removed from the particulating apparatus.

The method additionally includes applying an exhaust vacuum to the particulating apparatus for evacuating released and produced gas therefrom.

The method additionally includes recycling the plastic containers by using the disinfected plastic particulate produced by the particulating apparatus as source material in the manufacture of other items.

The method additionally includes dispensing a disinfecting agent upon the plastic containers and the plastic particulate within the pulverizing chamber for disinfecting the plastic particulate.

The method additionally includes dispensing a disinfecting agent upon the plastic containers prior to deposit into the pulverizing chamber for disinfecting the plastic containers.

The method additionally includes dispensing a disinfecting agent upon the plastic particulate downstream from the pulverizing chamber for disinfecting the particulate.

In another embodiment, a method of particulating liquid filled containers into particulate is disclosed that includes supplying containers, at least a portion of which contain liquid, to a pulverizing chamber. The containers are subjected to mechanical stress to break up the container walls to produce a particulate and to release the contained liquid. At least a portion of the released liquid is drained therefrom. The partially drained particulate is moved to a collection bin. The movement is directed upwardly to permit additional drainage of remaining liquid.

The method additionally includes supplying a disinfectant to the containers prior to movement to the collection bin.

Among those benefits and improvements that have been disclosed, other objects and advantages of this invention will become apparent from the following description taken in conjunction with the accompanying drawings. The drawings constitute a part of this specification and include exemplary embodiments of the present invention and illustrate various objects and features thereof.

DESCRIPTION OF THE PREFERRED EMBODIMENT OF THE PRESENT INVENTION

Figure 1:
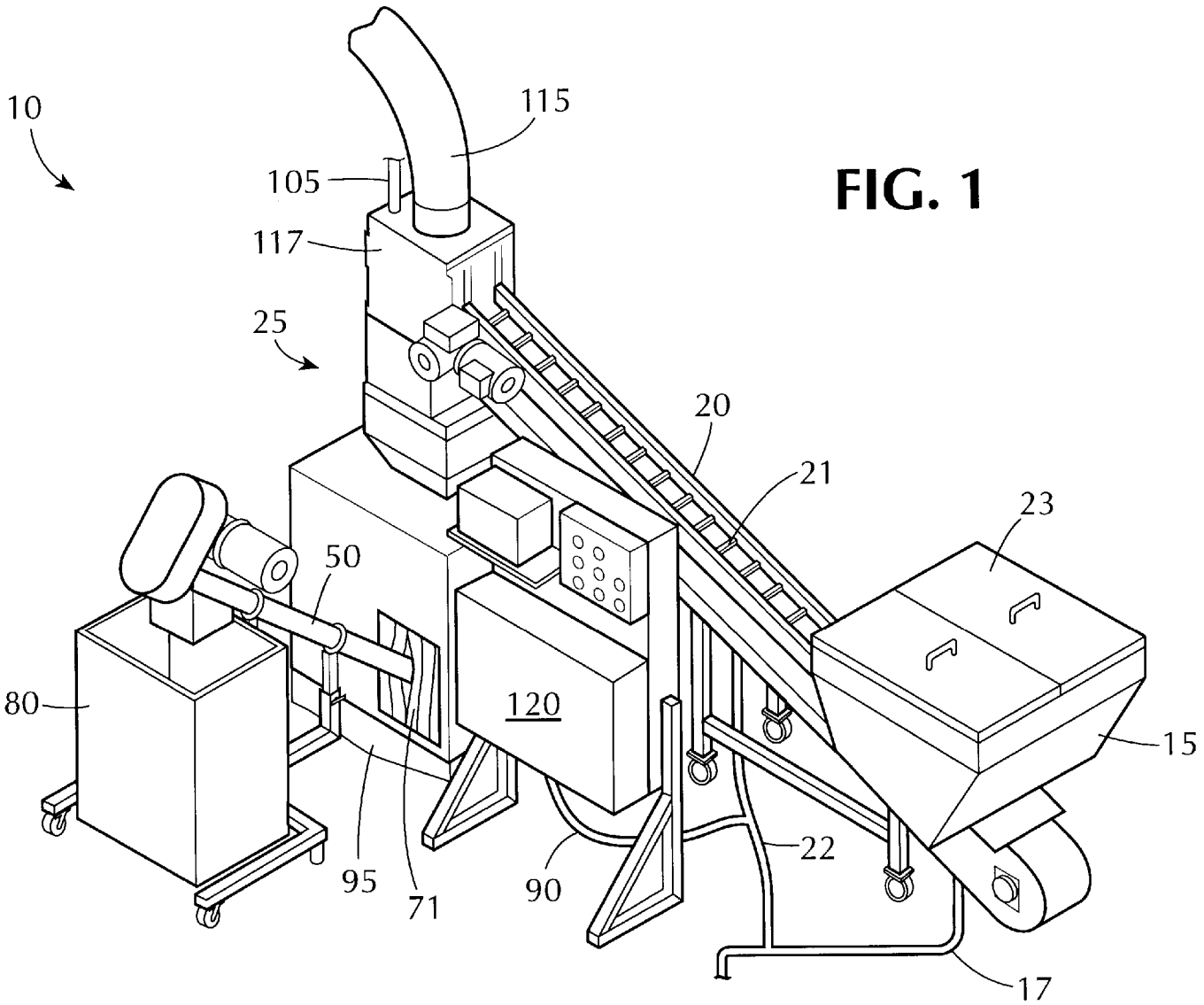
FIG. 1 is a perspective view of the particulating apparatus.

Detailed embodiments of the present invention are disclosed herein; however, it is to be understood that the disclosed embodiments are merely exemplary of the invention that may be embodied in various forms. The figures are not necessarily to scale and some features may be exaggerated to show details of particular components. Therefore, specific structural and functional details disclosed herein are not to be interpreted as limiting, but merely as a basis for the claims and as a representative basis for teaching one skilled in the art to variously employ the present invention.

Certain terminology will be used in the following description for convenience and reference only and will not be limiting. For example, the words "rightwardly", "leftwardly", "upwardly" and "downwardly" will refer to directions in the drawings to which reference is made. The words "inwardly" and "outwardly" refer to directions toward and away from, respectively, the geometric center of the structure being referred to. The words "backwardly" and "forwardly" refer to directions relative to the flow path of the containers being processed through the particulator. The terms "downstream" and "upstream" refer to relative locations along this flow path. The terminology used herein includes these words, specifically mentioned derivatives thereof, and words of similar import.

Figure 2:
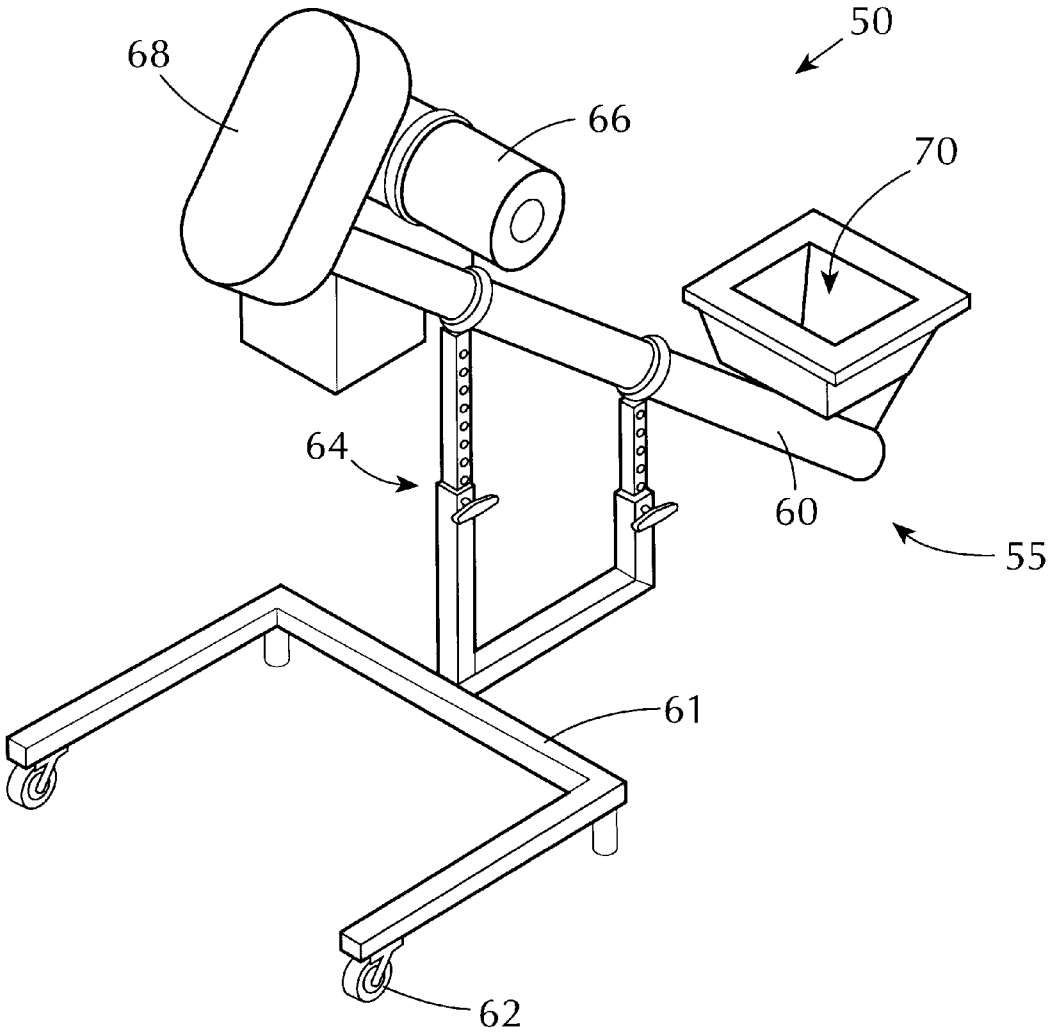
FIG. 2 is a perspective view of one of the conveyors of one of the particulating apparatus.
Figure 3:
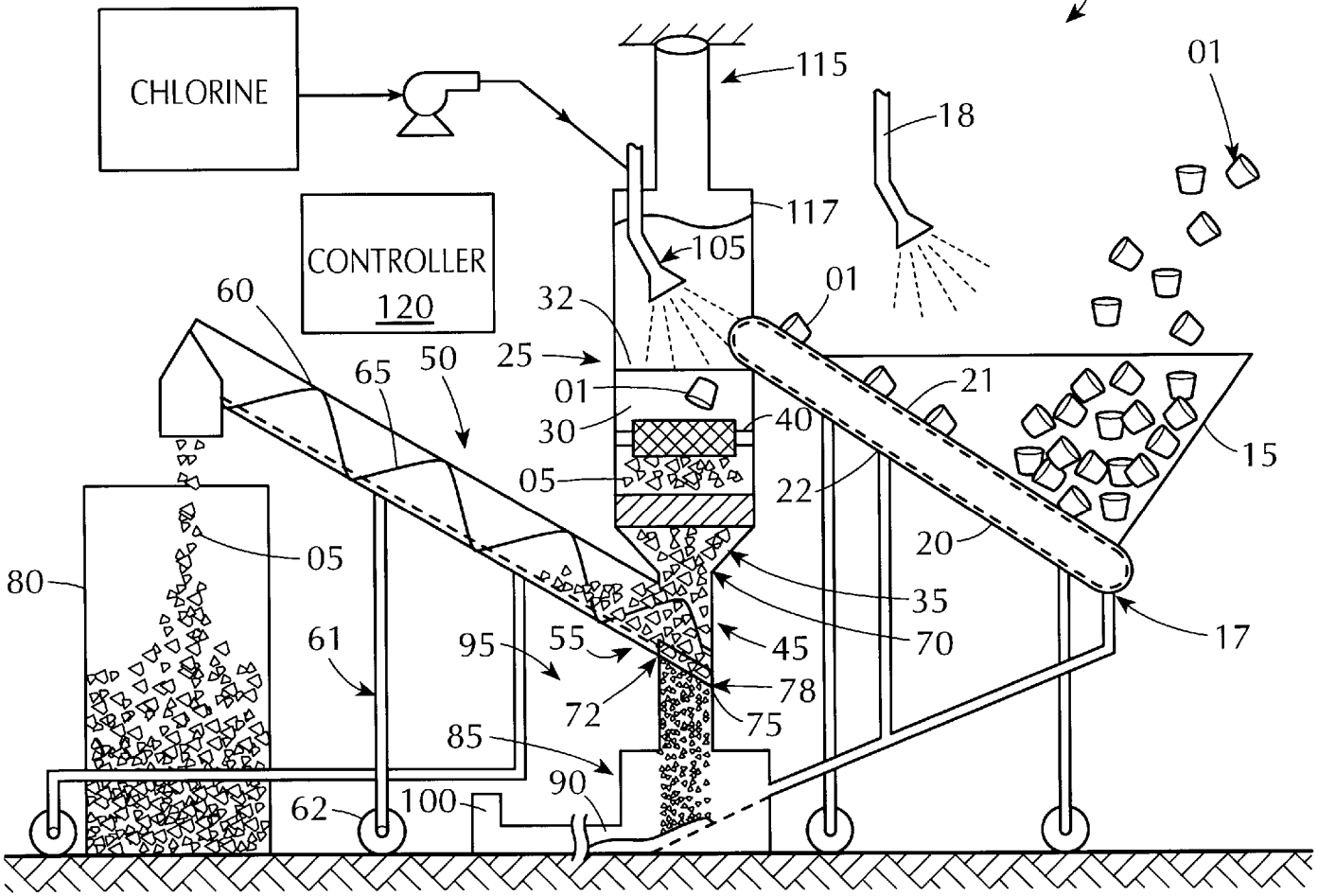
FIG. 3 is a schematic view of the particulating apparatus.
Figure 4:
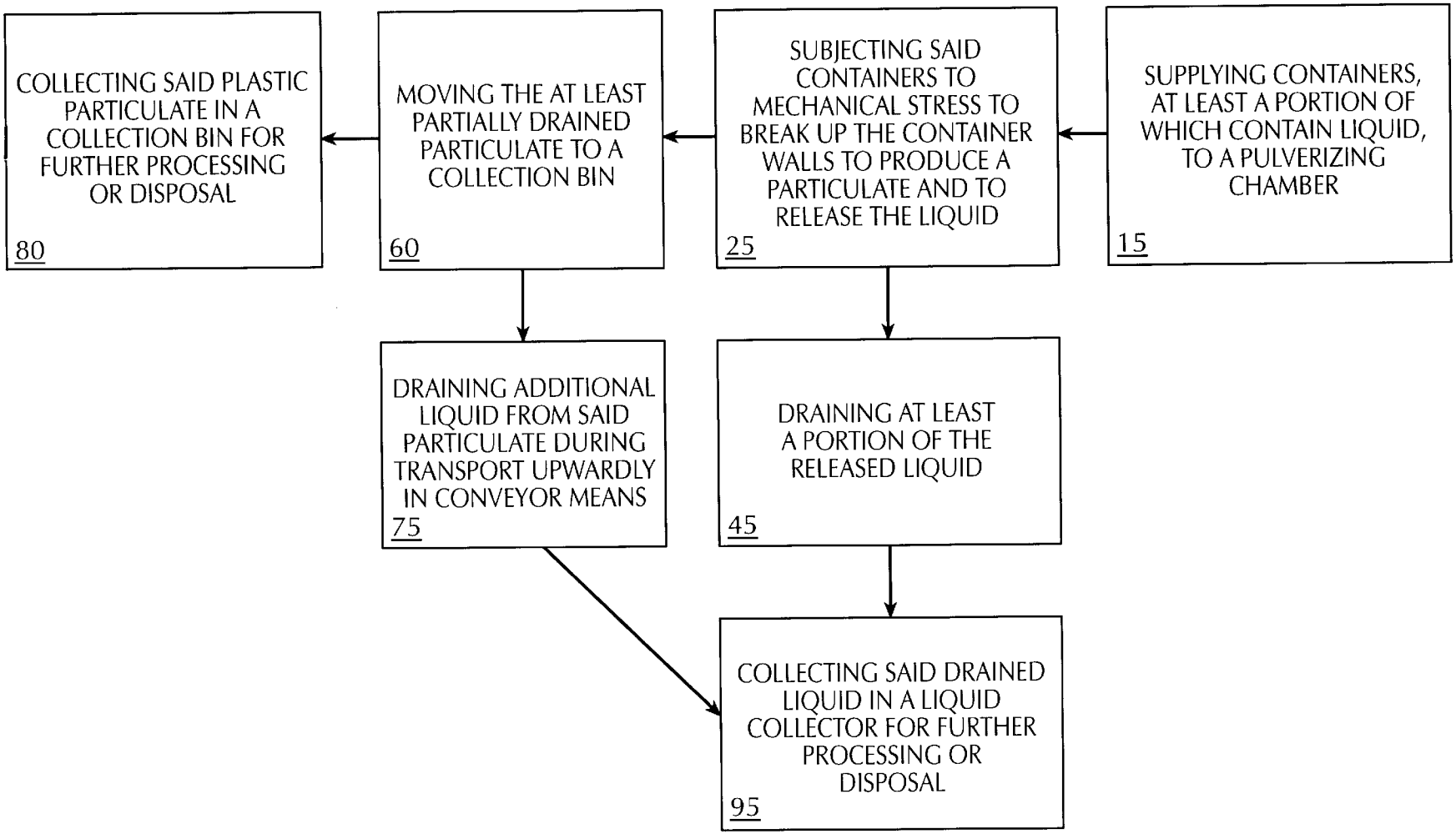
FIG. 4 is a block diagram representative of a flow path for materials being processed through the particulating apparatus.

Referring to FIG. 1–3, the primary components of the particulating apparatus 10, also referred to as the particulator 10 may be seen. A container hopper 15 is the right-most component with a transport 20 positioned adjacent thereto. Located at an opposite end of the transport 20 from the hopper 15 is a pulverizer 25. Positioned leftwardly of the. pulverizer 25 is a conveyor means 50 having a collection bin 80 located adjacent to a distal end of the conveyor means 50 away from the pulverizer 25. These several components are arranged so that a flow path is established thereacross. In the instance of the illustration of FIG. 1, the flow path extends from the right-hand side of the drawing where the hopper 15 is shown to the left-hand side of the drawing where the collection bin 80 is shown. In FIG. 1, the conveyor 50 from the pulverizer 25 to the collection bin 80 is perpendicularly oriented to the transport 20. This orientation is not critical. In the schematic of FIG. 3, however, the several primary components are longitudinally aligned to better illustrate the flow path of material from right to left through the particulating apparatus.

In operation, plastic containers 01 in the form of sample vials 01 that are at least partially liquid filled are pulverized into plastic particulate. It is contemplated that the plastic containers 01 may be opened to some a degree that they may not absolutely retain the liquid held therein when loaded into the container hopper 15. If the containers 01 are so opened, portions of the liquid specimens contained therein may spill out into the hopper 15 and become commingled with the other containers 01. The liquid is drained from the hopper 15 at a hopper drain port 17 either to a sewer system or to a liquid collecting reservoir. In an alternative embodiment, a pre-rinse applicator 16 is located at the hopper 15 for applying a rinse solution to the containers 01 for washing the commingled specimen liquid away in the hopper drain 17.

From the hopper 15, the containers 01 travel downstream on the transport 20 that in one embodiment is an inclined continuous belt conveyor 20. At an upper end of the transport 20 that is distally located from the container hopper 15, the sample vials 01 drop into the pulverizer 25. The pulverizer 25 comprises a pulverizing chamber 30 into which the vials 01 are deposited. Therein, a pulverizing means 40 breaks the walls of the vials 01 into pieces thereby releasing any liquid specimen held therein and fragments the containers 01 into plastic particulate 05. Because of the potentially corrosive nature of the liquid specimens that are released from the opened vials 01, certain components within the pulverizing chamber 30 are coated with a protective metal. In one embodiment, at least a portion of the interior walls of the pulverizing chamber 30 are nickel plated, as is a rotatable shaft upon which cutting blades are carried for particlizing the containers 01.

As the contained liquid is released from the vials 01, a substantial portion passes downwardly through the pulverizing chamber 30 and is drained therefrom through a drain means 45. The drain means 45 is also referred to as the pulverizing chamber drain port 45 because of its proximity thereto. That portion of the liquid that drains into the chamber drain 45 is at that point is separated from the plastic solids 05.

An additional portion or amount of liquid remains commingled with the plastic particulate 05 and is carried away from the pulverizer 25 by the conveyor means 50. The conveyor means 50 is configured so that as the particulate 05 continues to travel downstream toward the collection bin 80, the additional liquid drains therefrom and is directed back to the same liquid collector 95 within which the greater original portion of liquid had been caught from the pulverizing chamber 30. Ultimately, the particulate 05 is deposited in the collection bin 80 at a downstream location where it is held for either disposal or further processing such as being recycled for use as the construction material for other plastic items.

It is contemplated that a disinfectant applicator 105 may be positioned at any location along the flow path prior to the separation between the plastic particulate 05 and the liquid. It is preferred that the disinfecting agent applied to the plastic be distributed completely throughout the plastic particulate 05 to thoroughly disinfect the pieces of plastic particulate 05. To assure a thorough mixture of the disinfectant with the particulate 05, it is beneficial to apply the disinfectant either prior to or during the pulverization process so that the action of pulverization serves as a mixer for the particulate 05 within the liquid and disinfectant. In one embodiment, chlorine is used as the disinfectant. The chlorine is supplied to a pressured water stream by a feed pump thereby creating a disinfecting or sanitizing solution that is applied to the containers 01. In at least one embodiment of the present invention, the sanitizing solution is approximately eighty parts per million (80 ppm) chlorine to water and is sprayed into the pulverizing chamber 30 through the same top opening 32 through which the containers 01 are deposited into the chamber 30. The solution is sprayed through an applicator nozzle 105 that may take a form similar to a shower head. In this manner the sanitizing solution is dispersed upon the containers 01 and the particulate 05 during the pulverizing process.

Still further, an exhaust vacuum or port 115 may be applied to the particulator 10 for evacuating gases that are either released or produced in association with the particulating process. Depending upon the nature of the gas withdrawn, it may be released at a location remote from the particulator 10 where it will have a less offensive effect. In the event that the condition of the gas prevents its immediate release, it may be further treated before ultimately being released back to the atmosphere. An example of such a further treatment would be passing the gas through a scrubbing process or filter. In at least one embodiment, the exhaust vacuum is applied to the particulator 10 through a box styled hood that is positioned about the top opening 32 of the pulverizing chamber 30. An exhaust fan establishes a suction and the withdrawn gas is ported through an exhaust conduit to the exterior of the facility. In this way, the fumes from at least the chlorine are removed from the immediate area of the particulating apparatus 10.

Referring again to the container hopper 15, it may be appreciated that the walls of the hopper 15 are substantially funnel shaped down from a large open cross-sectional area at its top end to a reduced cross-sectional area at its bottom end. Plastic vials 01 that have been deposited into the hopper 15 are directed downwardly to the bottom end of the hopper 15 were they are loaded onto the transport 20. The open top of the hopper 15 may be made closable by one or more doors 23 that swing between open and closed positions.

In one embodiment, the transport 20 is an inclined continuous belt conveyor 20 upon which the vials 01 are carried for upward inclined travel toward the pulverizer 25. The belt 20 runs between guides that establish a transporting track atop the belt 20. Width wisely oriented elevated slats 21 are included on the top surface of the belt 20 that act as pushers upon which the vials catch and are prevented from tumbling backwardly down the moving transport 20. It is also contemplated that the transport's 20 upper surface upon which the vials 01 are carried may be porous thereby provided a further draining capability of free liquid during the transport process. In this configuration, a pan (not shown) is provided below the porous belt conveyor 20 that catches liquid that drains therethrough and directs the same to a transport drain port 22 or to the hopper drain port 17.

As previously described, the vials 01 drop from an upper end of the belt conveyor 20 into the pulverizing chamber 30 within which the pulverizing means 40 is housed. At the time a particular vial 01 is deposited into the pulverizing chamber 30, it may be totally empty, partially full, or substantially liquid filled. As the vial 01 encounters the pulverizing means 40 the walls of the container 01 are broken apart thereby releasing any liquids that may be held therein. One embodiment of the pulverizer 25 utilizes a Model G810P1 Granulator provided by the Nelmor Co. Inc. of North Uxbridge, Mass. The pulverizer 25 of this embodiment includes rotor knives and bed knives that together fragment the bodies of the sample vials 01. It is contemplated that the pulverizing means 40 may include other modes of fragmenting the walls of the containers 01. These means may include other types of cutting apparatus, as well as hammer-mill type structures which forcibly break apart the vials 01 by applying appropriate stresses thereto. How the containers 01 are broken down is not critical, but what is critical is that the walls are fragmented and that the carried liquid is released therefrom.

In one embodiment, a lower portion of the pulverizer 25 is configured in a funnel like fashion that directs the fragmented plastic particulate 05 to a reduced cross-section particulate exit 35. Also at the lower portion of the pulverizer 25 is the pulverizing chamber drain port 45 through which liquid is drainable from the pulverizer 25. The drain means 45 includes a passage through which liquid may drain from within the interior of the pulverizing chamber 30 to a drain pan 85 of the liquid collector 95. In at least one instance, the passage for the drain means 45 is the same as the passage for the particulate exit 35.

From the particulate exit 35, the particulate 05 is directed into a particulate entrance port 70 of the conveyor means 50. A direct connection may be made between the exit 35 and the entrance 70, but the pulverizer 25 and the conveyor 50 may be relatively positioned so that both particulate 05 and liquid that exit the pulverizing chamber 30 are deposited into the conveyor's 50 entrance 70. In the event that the components are not directly mated between the exit 35 and entrance 70, flexible flaps or curtains 71 may be provided that act as containing shields about the interface between the exit 35 and the entrance 70 and the entrance of the conveyor means 50 into the pulverizer's 25 housing.

The particulate entrance port 70 of the conveyor means 50 is located at a lower end 55 of the conveyor 50. A conveyor drain port 72 that includes liquid drainage apertures 75 is located below the entrance port 70. The drainage apertures 75 port an additional quantity of liquid that drains from the particulate 05 as it is transported in the conveyor means 50. In the illustrated embodiment, all liquid drains from within the pulverizing chamber 30 into the conveyor means 50 with the particulate 05 and is ported to the drain pan 85 of the liquid collector 95 through the drainage apertures 75.

In one embodiment, the conveyor means 50 is a screw conveyor that includes a cylindrical housing or sleeve 60 having a rotatable screw 65 contained therein. The screw 65 is rotated by motor 66 that is connected to the screw 65 by a belt drive contained within belt housing 68. The conveyor 50 is carried on a rollable stand 61 having caster wheels 62. A height adjustment means 64 is included on the stand 61 for varying the vertical position of the conveyor 50.

As the screw 65 rotates within the housing 60, the particulate 05 which has been fed thereto from the pulverizer 25 is transported upwardly at an angle to horizontal. The angle may be between 30 and 60 degrees, and is preferably about 45 degrees. By orienting the screw conveyor 50 at an inclined angle, additional liquid that has been carried with the particulate 05 drains therefrom and settles to a lower portion of the cylindrical housing 60. There, the lower portion of the housing or sleeve 60 acts as a guide or channel for the liquid and directs it backwardly and downwardly toward the drainage apertures 75.

In one embodiment, the drainage apertures 75 are included in a screen 76 that is an arc shaped sheet of screening the conforms to the shape and size of the sleeve 60. The screen 76 is hinged to the sleeve 60 so that it may be pivoted from a latched closed position to an open unlatched position thereby creating an opening through which access to the interior of the conveyor 50 may be gained. Among others, this access may be used to clean matter from the conveyor 50 that has become lodged therein. Materials other than only the plastic and liquid may be introduced into the particulator. For instance, if the sample vials 01 have paper labels affixed thereto, those labels will be processed with the vials 01. Upon reaching the screw conveyor 50, the paper pieces may adhere to the drain screens 76 and compromise their draining capabilities; therefore, it is desirable to have the capability to swing the screen 76 open and clean out the foreign matter.

When the particulate 05 reaches a top end of the screw conveyor 50, it is substantially liquid free and may be conveyed into the collection bin 80. In one particular embodiment of the screw conveyor 50, a stainless steel screw auger Model HCV-60/4 that is manufactured and distributed by the Hance Corporation of Westerville, Ohio is utilized. The sleeve 60 of the conveyor 50 has a four inch outer diameter and is constructed for sixteen gauge stainless steel. The screw 65 has a three and one-sixteenth outer diameter and is also constructed from stainless steel. In one embodiment, the screw 65 is equipped with a polyurethane 80 durometer wiper and three drain screen locations. In the preferred embodiment, however, there is no wiper and only one screen 76 at the lower end of the sleeve 60. Without the wiper, the screw 65 moves the solid particulate up the conveyor 50, but the liquid is allowed to drain backward down the sleeve to the single lower screen 76. This is made possible by the clearance space between the screw 65 and sleeve 60, however narrow, that is left in the absence of the wiper.

It is contemplated that the conveyor means 50 may include other embodiments such as a porous belt continuous conveyor having a drain pan provided thereunder that acts as a guide for draining the additional liquid toward the liquid collector 95.

It is also contemplated that the liquid collector 95 may comprise a plurality of drain pans 85 which are connected by drain conduit 90. In this way, each drain pan 85 may be in fluid communication with a central liquid collecting reservoir 100 where the drained liquids are retained for disposal or for further processing. In the event that the liquid drained from the particulating apparatus 10 is suitable for direct disposal into an available sewer system, the liquid collector 95 may be ported directly thereto and not require the inclusion of a liquid reservoir 100.

The particulator 10 has a central control unit or controller 120 through which power for various components of the system is supplied and distributed. The controller 120 may optionally include a programmable logic controller (PLC) capable of communication with, and control of the several operating components of the particulator 10. In this way, conditions within the operating components may be monitored to assure that proper working conditions are being maintained and to coordinate the several component's interaction, where appropriate. The controller 120 may also be utilized as an alarm to indicate when unacceptable working conditions are encountered, or alternatively can automatically shut down the system when certain predetermined working parameters are exceeded.

During operation, the particulators 10 disclosed herein require an electrical power source and a water supply. Therefore, portable power generation may be included as a component of the system, or a suitable power source must be available at the site. Similarly, water-solution reservoirs must be included in the system, or a water supply must also be available at the particulating site.

A particulating apparatus and a method for particulating have been described herein. These and other variations, which will be appreciated by those skilled in the art, are within the intended scope of this invention as claimed below. As previously stated, detailed embodiments of the present invention are disclosed herein; however, it is to be understood that the disclosed embodiments are merely exemplary of the invention that may be embodied in various forms.

What is claimed and desired to be secured by Letters Patent is as follows:

1. A particulating apparatus for liquid specimen filled plastic containers in preparation for recycling of produced plastic particulate, said particulating apparatus comprising:

a container hopper for accepting a supply of plastic containers to be processed by said particulating apparatus wherein at least a portion of said containers are partially or fully filled with a liquid specimen;

a transport for conveying said supply of plastic containers from said hopper to a pulverizer, said pulverizer comprising a pulverizing chamber within which a pulverizing means is housed for reducing said plastic containers to plastic particulate, said chamber including means for draining liquid held within said containers to a liquid collector;

conveyor means for transporting plastic particulate from said pulverizer to a collection bin where said particulate is retained for further processing or disposal, said conveyor means being inclined at least partially vertically upwardly to permit drainage of additional liquid form the particulate;

first rinsing means for washing said plastic containers while said containers are in said hopper, or while said containers are conveyed from said hopper to said pulverizing chamber for flushing liquid specimens from said plastic containers; and a disinfectant applicator for dispensing a disinfecting agent onto said plastic particulate before said particulate is conveyed to said collection bin.

2. The particulating apparatus as recited in claim 1; said particulating apparatus further comprising:

a second rinsing means within said pulverizing chamber for washing additional amounts of said liquid specimen from said particulate.

3. The particulating apparatus as recited in claim 2 wherein said conveyor means includes a housing for directing the additional liquid drained from the particulate while in said housing toward said liquid collector.

4. The particulating apparatus as recited in claim 3; wherein said inclined conveyor means for transporting plastic particulate form said pulverizer to said collection bin farther comprises:

said housing being substantially cylindrically shaped and having a rotatable screw housed therein;

a plastic particulate entrance port located at a lower end of said conveyor means and positioned proximate to a particulate exit of said pulverizing chamber;

liquid drainage apertures in said housing for permitting liquid to drain therefrom to said liquid collector; and wherein said pulverizing apparatus further comprising a draining means within said hopper for withdrawing any liquid specimens released from said plastic containers while in said hopper.

5. The particulating apparatus as recited in claim 1; said particulating apparatus further comprising:

a draining means within said transport for withdrawing any liquid specimens released from said plastic containers while on said transport.

6. The particulating apparatus as recited in claim 1; said particulating apparatus further comprising:

a disinfectant applicator for dispensing a disinfecting agent onto said plastic containers within said pulverizing chamber so that said produced plastic particulate is at least partially disinfected in preparation for additional processes in which plastic particulate is consumed or disposed.

7. The particulating apparatus as recited in claim 1; wherein said liquid collector comprises at least one drain pan positioned at least partially below said pulverizer, said drain pan having a drain conduit fluidly connected between said drain pan and a liquid collecting reservoir.

8. The particulating apparatus as recited in claim 7; wherein said at least one drain pan comprises a plurality of drain pans, said plurality of drain pans being fluidly communicated with one another for common drainage through said drain conduit.

9. The particulating apparatus as recited in claim 1; further comprising:

an exhaust vacuum fluidly connected to said particulating apparatus for removing gas therefrom.

10. The particulating apparatus as recited in claim 1; wherein said transport for conveying said supply of plastic containers from said hopper to said pulverizer is an inclined continuous belt conveyor.

11. A method for particulating liquid specimen filled plastic containers into plastic particulate, said method comprising the steps of:

supplying a plurality of plastic containers to a pulverizing chamber of a particulating apparatus wherein at least a portion of said plastic containers are partially or fully filled with a liquid specimen;

dispensing a first liquid rinse onto said plastic containers to wash said containers before said containers are introduced into said pulverizing chamber;

pulverizing said plastic containers thereby producing plastic particulate from said containers and releasing said liquid from within said containers;

dispensing a disinfectant agent upon said plastic containers and said plastic particulate within said pulverizing chamber for disinfecting said plastic particulate;

draining a portion of said released liquid specimen and said disinfectant agent from said pulverizing chamber;

collecting said drained liquid specimen and said disinfectant agent in a liquid collector for further processing or disposal;

collecting said plastic particulate in a collection bin for further processing or disposal.

12. The method for particulating liquid filled plastic containers into plastic particulate as recited in claim 11, comprising:

dispensing a second liquid rinse into said pulverizing chamber to wash additional amounts of said liquid specimen from said particulate within said pulverizing chamber;

transporting said plastic particulate from said pulverizing chamber to said collection bin in a conveyor means, said conveyor means being inclined at least partially vertically upwardly toward said collection bin; and draining additional liquid from said particulate during transport upwardly in said conveyor means.

13. The method for particulating liquid filled plastic containers into plastic particulate as recited in claim 12, further comprising:

porting said conveyor means with liquid drainage apertures so that said additional liquid drained from said particulate is permitted to exit said conveyor means into said liquid collector.

14. The method for particulating liquid filled plastic containers into plastic particulate as recited in claim 12, further comprising:

draining any liquid specimens released from said plastic containers while in said hopper; and collecting said additionally drained liquid from within said conveyor means together with said initially drained liquid from within said pulverizing chamber in said liquid collector.

15. The method for particulating liquid filled plastic containers into plastic particulate as recited in claim 14, wherein said collection of liquid further comprises positioning at least one drain pan beneath said pulverizing chamber and said drainage apertures of said conveyor means.

16. The method for particulating liquid filled plastic containers into plastic particulate as recited in claim 15, further comprising:

draining collected liquid from said drain pan to a liquid collecting reservoir for retention until said collected liquid is removed from said particulating apparatus.

17. The method for particulating liquid filled plastic containers into plastic particulate as recited in claim 11, further comprising:

applying an exhaust vacuum to said particulating apparatus for evacuating released and produced gas therefrom.

18. The method for particulating liquid filled plastic containers into plastic particulate as recited in claim 11, further comprising:

recycling said plastic containers by using said disinfected plastic particulate produced by said particulating apparatus as source material in the manufacture of other items.

19. The method for particulating liquid filled plastic containers into plastic particulate as recited in claim 11, further comprising:

dispensing a disinfecting agent upon said plastic containers prior to deposit into said pulverizing chamber for disinfecting said plastic containers.

20. The method for particulating liquid filled plastic containers into plastic particulate as recited in claim 11, further comprising:

dispensing a disinfecting agent upon said plastic particulate downstream from said pulverizing chamber for disinfecting said particulate.

21. A method of particulating liquid filled containers into particulate, comprising the steps of:

washing containers before said containers are introduced into a pulverizing chamber;

conveying said washed containers, at least a portion of which contain liquid, to said pulverizing chamber;

subjecting said containers to mechanical stress to break up the container walls to produce a particulate and to release the contained liquid from within said containers;

draining at least a portion of the released liquid;

moving the at least partially drained particulate to a collection bin, said movement being directed upwardly to permit additional drainage of remaining liquid; and dispensing a disinfectant agent upon said particulate before said particulate is conveyed to said collection bin.

22. The method of claim 21, further comprising the step of dispensing said disinfectant upon the containers prior to breaking up the container walls to produce a particulate.

* * * * *